US006044676A

United States Patent [19]

Sun

[11] Patent Number: 6,044,676

[45] Date of Patent: Apr. 4, 2000

[54] METHOD FOR MAKING HOLLOW WORKPIECES

[75] Inventor: Tyzh-Chiang Sun, Danville, Calif.

[73] Assignee: Alcoa Inc., Pittsburgh, Pa.

[21] Appl. No.: 09/049,063

[22] Filed: Mar. 27, 1998

Related U.S. Application Data

[63] Continuation of application No. 08/698,503, Aug. 15, 1996, Pat. No. 5,742,993, and a continuation of application No. 08/553,080, Nov. 3, 1995, Pat. No. 5,862,582.

[51] Int. Cl.[7] ..... B21D 37/18

[52] U.S. Cl. ..... 72/45

[58] Field of Search ..... 72/43, 44, 45, 72/46, 347, 349, 467

[56] References Cited

U.S. PATENT DOCUMENTS

| | | | |
|---|---|---|---|
| 3,930,396 | 1/1976 | Martinez | 72/467 |
| 4,223,544 | 9/1980 | Main | 72/45 |
| 4,881,394 | 11/1989 | Jansen | 72/45 |
| 5,678,439 | 10/1997 | Dunwoody et al. | 72/45 |

*Primary Examiner*—Lowell A. Larson
*Attorney, Agent, or Firm*—Jones, Tullar & Cooper

[57] ABSTRACT

A method for making hollow workpieces such as beverage containers with a circular die in which an aluminum alloy is strip cast whereby the alloy is solidified rapidly without substantial precipitation. Thereafter, the aluminum alloy is formed into a cup which is drawn and passed through one or more dies to iron the walls of the cup and thereby lengthen the side walls thereof using at least one circular die having a die angle of less than about 6 degrees and a chamfer angle of less than 35 degrees. It has been found that the use of such die angles prevents or minimizes galling and tearoffs.

4 Claims, 7 Drawing Sheets

METHOD FOR MAKING HOLLOW WORKPIECES

CROSS REFERENCE TO RELATED APPLICATIONS

This application is a continuation of U.S. Ser. No. 08/698,503, filed Aug. 15, 1996 now U.S. Pat. No. 5,742,993.

This application is a continuation-in-part of application Ser. No. 08/553,080, filed Nov. 3, 1995 now U.S. Pat. No. 5,862,582.

BACKGROUND OF THE INVENTION

The present invention relates to a method for the manufacture of hollow workpieces, and more particularly to the manufacture of hollow workpieces such as beverage containers from aluminum alloys.

PRIOR ART

It now conventional to manufacture hollow workpieces such as beverage containers from aluminum alloys. An aluminum alloy sheet stock is first blanked into a circular configuration and then cupped in accordance with well established techniques. The side walls are then redrawn and ironed by passing the cup through a series of dies, typically two or more, having diminishing bores. The dies thus produce an ironing effect which lengthens the side wall to produce a can body in which the side walls are thinner in dimension than its bottom.

One of the key characteristics of aluminum alloys used in the manufacture of such cans is the surface quality. To be commercially acceptable, the aluminum alloy sheet stock used in the manufacture of such cans must have a high surface quality free from scratches or other undesirable surface characteristics. For the most part, aluminum alloy sheet stocks used in the manufacture of beverage containers have been fabricated using well known ingot methods. The continuous casting of thin aluminum alloy strips is well known, but has, until recently, enjoyed little success primarily due to surface quality related problems. It has been generally recognized that continuous casting of metal strip has been limited to a relatively small number of alloys and products produced therefrom.

It has recently been discovered that strip casting of aluminum alloys to produce a strip cast alloy having surface qualities acceptable for use in can making can be achieved by carefully controlling the conditions under which aluminum alloys are strip cast. For example, in co-pending application issued as U.S. Pat. No. 5,515,908 on May 14, 1996, the disclosure of which is incorporated herewith by reference, there is described a dramatically improved process and apparatus for use in the strip casting of aluminum alloys in which aluminum alloys are deposited on a molding zone defined by a pair of continuous endless belts formed of a heat conductive material. As described in that copending application, each of the belts is mounted on a pulley whereby each of the belts defines curved surfaces about the pulley and thereafter a substantially flat surface. As described in the foregoing copending application, when the molten aluminum alloy is deposited on the curved surfaces of both belts, the molten alloy transfers heat to the metal belts. Distortion of the belts by reason of the deposition of a molten metal on an otherwise cool belt is substantially minimized because the belts are supported by the pulleys at the point at which the molten metal is deposited upon the belts. The heat thus transferred to the belts can then later be removed by cooling the belts when they are not in contact with either the molten metal or the hot cast metal strip.

Thus, the concept of casting on a curve coupled with cooling the belts at a point at which the belts are not in contact with either the molten metal or the cast metal strip avoids, or at least substantially minimizes, thermal distortion of the belts which would otherwise adversely affect the surface characteristics of the cast metal strip. For that reason, the invention as described in the foregoing copending application represents a dramatic improvement in the strip casting of aluminum alloys which enables aluminum alloys so cast to be used in the manufacture of aluminum alloy beverage containers. Even further improvements in the strip casting technique described in the foregoing application are illustrated in copending application, Ser. No. 173,369, filed Dec. 23, 1993, now U.S. Pat. No. 5,564,491 the disclosure of which is incorporated herewith by reference. In the invention disclosed in the latter application, use is made of means to control the spacing between the belts so that the nip defined by the plane passing through the axes of both pulleys exerts a compressive force on the metal being cast. In the invention described in that application, the molten metal is deposited on the curved surfaces of the belts and substantially solidifies thereon prior to the nip between the entry pulleys. In that system, the compressive force exerted on the frozen cast strip at this nip causes elongation thereof so that the cast strip is in compression in the direction of travel after it exits from the nip. It has been found that the longitudinal compression in conjunction with the compression exerted by the nip substantially minimizes cracking of the cast metal strip, thus dramatically improving the surface quality of the as-cast strip.

It has been discovered that the aluminum alloy strip cast according to the techniques described in the foregoing copending applications has unique characteristics. Without limitation as to theory, it is believed that the strip casting techniques described in the foregoing copending applications cause the aluminum alloy to freeze or solidify extremely rapidly to create a unique micro-structure. Not only is the microstructure unique, so too are the metallic characteristics of the cast strip unique. By rapidly freezing or solidifying the aluminum alloy, there is insufficient time for precipitation of the alloying elements present in the aluminum alloy. As is well understood in the art, the precipitation of alloying elements present in the aluminum alloy as intermetallic compounds is a phenomenon related to both time and temperature. In the systems described in the foregoing copending applications, the aluminum alloys are frozen or solidified so rapidly that there is insufficient time for such alloying elements to precipitate as intermetallic compounds.

Thus, the strip casting of aluminum alloys using those techniques are characterized by substantially improved surface quality. It has been found, however, that aluminum alloys produced by such strip casting techniques have, when used in the manufacture of aluminum beverage containers, a tendency toward galling. Galling is a phenomenon which occurs during the ironing of a cup through series of dies in which aluminum from a preceding can adheres to the die. When the next cup is processed by the die, the aluminum alloy adhering to the die adversely affects the surface characteristics of the can walls.

As described in copending application, Ser. No. 553,080, filed Nov. 3, 1995, the disclosure of which is incorporated herein by reference, it has been found that the galling phenomenon exhibited by strip cast aluminum alloys which have been rapidly solidified can be eliminated or at least substantially minimized by using one or more dies in which the die angle of less than about 6 degrees. Can ironing operations prior to the invention described in the foregoing application have generally employed dies using a die angle of about 8 degrees. Without limiting the invention disclosed and claimed in the foregoing copending application, it is believed that the narrower die angle allows more of the fluid applied as a coolant and as a lubricant to pass through the die as the cup is passed through the die. It is believed that the oil ruptures the surface of the metal to hold lubricant in place in the die, and that, in turn, substantially reduces galling.

It has now been found that the use of dies having a die angle less than about 6 degrees and a chamfer angle of about 35 degrees can be used in making hollow workpieces which serve to improve the processing of all aluminum alloys. The concepts of the present invention can be used not only to minimize galling in aluminum alloys which have been strip cast by rapid solidification but also aluminum alloys which have been produced by other casting techniques, including ingot casting techniques.

It is accordingly an object of the invention to provide an improved method for the manufacture of hollow workpieces such as beverage containers from aluminum alloys which have been strip cast as well as aluminum alloys produced by other casting techniques.

It is a more specific object of the invention to provide a method for making hollow workpieces such as beverage containers and the like in which the tendency of the aluminum alloy to cause galling is either eliminated or at least substantially reduced.

It is yet another object of the invention to provide a method for making hollow workpieces from aluminum alloys in which galling is reduced or substantially minimized by controlling the tooling geometry used in can making.

These and other objects and advantages of the invention appear more fully hereinafter from a detailed description of the invention.

SUMMARY OF THE INVENTION

The concepts of the present invention reside in the discovery that the formation of hollow workpieces can be dramatically improved where an aluminum alloy is formed into cups and the cups are ironed through at least two dies to iron the walls of the cup and thereby lengthen its sidewalls to reduce the thickness thereof in which the tool geometry is controlled to insure that at least one of the ironing dies has a die angle of less than 6 degrees and a chamfer angle of less than about 35 degrees. Without limiting the present invention as to theory, it is believed that the narrower die angle of less than 6 degrees allows more of the cooling and lubricating fluid to pass through the die during the ironing operation. That, in turn, causes the cooling fluid to rupture the surface of the metal to hold lubricant in place in the die to thereby increase the efficiency of the ironing operation. The use of a die angle of less than about 6 degrees has the beneficial effect of reducing galling and tearoffs by reason of better lubrication and ironing force distribution. Ironing force distribution, it is believed, is improved with the reduced die angle; a greater percentage of the load created during the ironing operation is carried between inside friction between the punch and the can, unless by the can wall tension. That serves to reduce both galling effects as well as tearoffs of the can walls. The control of the chamfer angle has been found to improve flow of the coolant/lubricant in the ironing zone, as compared to prior art systems utilizing a 45 degree chamfer angle.

The concepts of the invention can be employed to improve the ironing operations of aluminum alloys which have been strip cast and rapidly solidified without substantial precipitation of alloying elements as described in the foregoing patents and copending applications. The concepts of the present invention are not, however, limited to strip cast aluminum alloy can body stock which has been rapidly solidified. It has been found, in accordance with the practice of the invention, that the present invention likewise reduces galling and tearoffs for aluminum alloys, independent of the method of forming the aluminum alloy workpiece. The concepts of the present invention are equally applicable to aluminum alloy strips produced by conventional ingot casting techniques, for example.

In accordance with a preferred embodiment of the present invention, a lubricant/coolant is supplied to the die during the ironing of a cup in the form of an annular sheet of lubricant/coolant fluid, and preferably an annular sheet in which the motion of the lubricant/coolant is a whirling motion supplied substantially parallel to the chamfer of the die to insure maximum lubricant/coolant flow efficiency to the cup undergoing ironing.

DETAILED DESCRIPTION OF THE INVENTION

Figure 1:
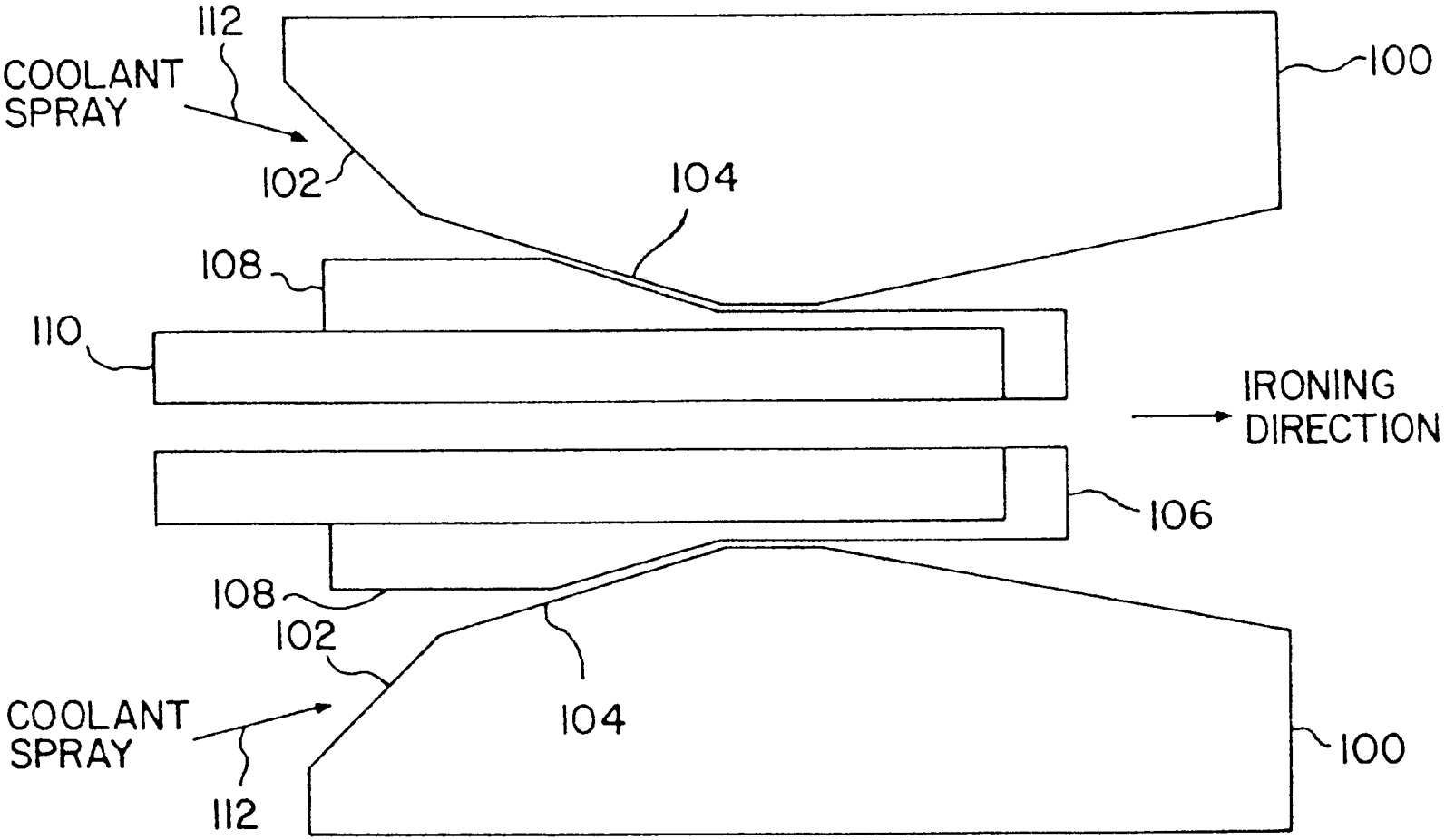
FIG. 1 is a cross sectional view of an ironing die typically used in the prior art.

The concepts of the present invention can best be illustrated by first describing prior art ironing operations typically employed as illustrated in FIG. 1 of the drawings. The conventional die arrangement includes an annular ironing die 100 having a chamfer 102 and a working surface 104 attached to engage a cup 106 and specifically the wall thereof 108. As is conventional, a punch 110 is inserted into the cup and drives the cup through the die 100 whereby the working zone of the ironing die engages the can wall 108 to lengthen the side walls 108 and, at the same time, reduce their thickness.

It is generally the practice in the prior art to employ an ironing die having a working surface 104 which forms about an 8 degree angles between the working surface 104 and the punch 110. The chamfer 102 in conventional systems of the prior art defines typically a 45 degree angle with the punch.

The chamfer itself does not contact the metal but serves to direct coolant fluid from a source lubricant/coolant 112 into the space defined between the ironing die and the can wall 108.

As illustrated in FIG. 1, the point of intersection on the ironing die between the working chamfer 102 and the working surface 104 is typically an obtuse angle.

Figure 2:
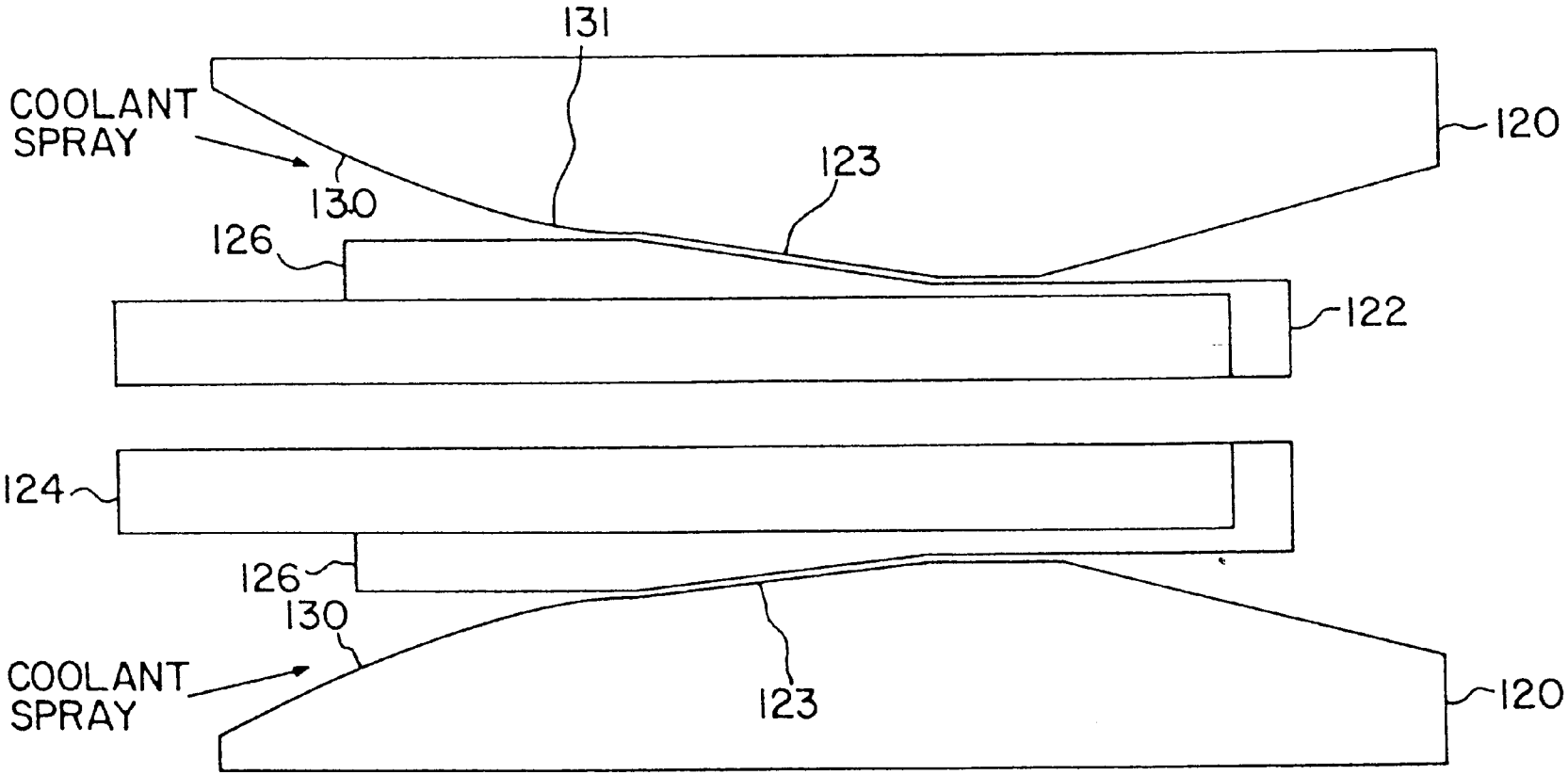
FIG. 2 is a cross sectional view of the ironing die employed in the practice of the present invention.

The concepts of the present invention are illustrated in FIG. 2 of the drawings utilizing an annular ironing die 120 through which a workpiece 122 is advanced by means of a punch 124 to lengthen the side walls 126 while, at the same time, reducing their thickness. The ironing die employed in the practice of the present invention likewise uses a working surface 128 which serves to engage the can wall to iron and lengthen it while simultaneously reducing its thickness. In accordance with the concepts of the present invention, however, the angle formed by the working surface 128 relative to the punch is a shallower angle as compared to those of the prior art. In general, use is made of a die angle less than 6 degrees, and preferably less than 5 degrees. In general, use can be made of die angles within the range of 4 to 6 degrees, and it is preferred that at least one of the ironing dies have that shallow angle. In the most preferred practice of the invention, two ironing dies are employed and each has a die angle less than 6 degrees. Whereas the reduction in the wall thickness effected by each die can be varied between 10% and 50%, it is generally preferred that use be made of two dies in which each die reduces the side wall thickness of the can by 35% to 45% for each die.

The die employed in the practice of the present invention likewise has a chamfer 130. Unlike the 45 degrees and 0.060 inch length chamfer typically employed by the prior art, it is generally preferred that the chamfer of the ironing die employed in the present invention define a chamfer length greater than 0.120 inches and an angle relative to the punch of less than 35 degrees, and preferably within the range of 20 to 30 degrees of chamfer. It has been found that with the use of longer and shallower chamfer angles, control of the lubricant/coolant can be more efficient. It is generally preferred that the lubricant/coolant sprayed at an angle to the punch which is substantially less than the chamfer angle, preferably at an angle between 8 and 20 degrees to the punch as illustrated in FIG. 2. That longer chamfer tends to open up the die to receive the coolant/lubricant to insure that a greater quantity of coolant/lubricant passes through the die along with the can body itself. As indicated above, the coolant sprayed in a direction substantially parallel to the punch is directed more effectively to the working zone of the die for better die cooling and lubrication. Without limiting the invention as to theory, it is believed that the chamfer and the working surface angle cooperate each with the other to insure that more lubricant/coolant passes through the die whereby the lubricant/coolant ruptures the surface of the metal to hold the lubricant in place to thereby reduce galling and tearoffs by reason of better lubrication.

In the preferred practice of the present invention, use is made of a lubricant/coolant spray serves not only to cool but to lubricate the can walls as they pass through the ironing die 130. Conventional lubricants/coolants may be used for that purpose, and are typically formulated to include a mixture of water and oil. In such conventional systems, the cooling fluid, typically applied as a liquid, serves to both cool and lubricate the passage of the can through the die.

In the preferred practice of the present invention, the lubricant/coolant is supplied to the die by spraying at a shallower angle in a direction substantially parallel to the punch in such a way that the lubricant/coolant is sprayed between the can wall and the chamfer as illustrated in FIG. 2 in the form of an annular stream of lubricant/coolant. In the most preferred embodiment of the invention, the lubricant/coolant is supplied not only as an annular stream of fluid, but a stream in which the lubricant/coolant is swirling without a substantial loss in kinetic energy.

Figure 3:
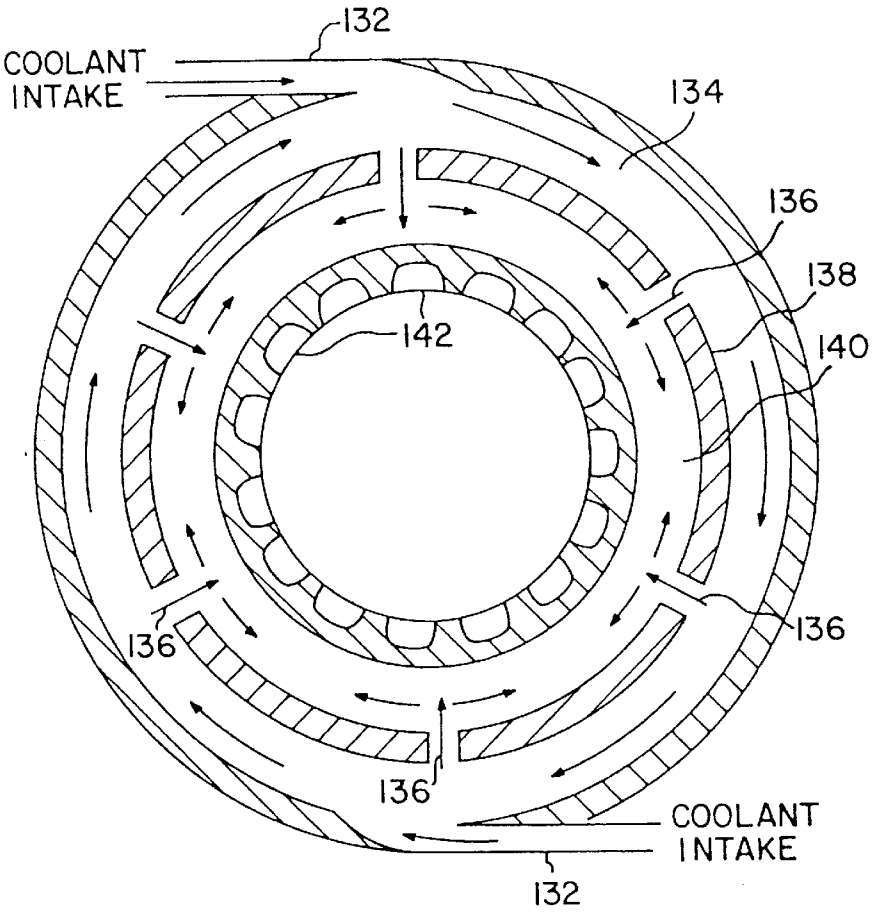
FIG. 3 is a cross sectional view of a conventional coolant distributor typically employed in the prior art.

That effect may be illustrated by reference to FIGS. 3 and 4. FIG. 3 illustrates a conventional coolant distributor typically employed in the prior art in which a lubricant/coolant is supplied radially to a pair of intakes 132 and passes into an outer annular chamber 134 as illustrated in FIG. 3. The lubricant/coolant then passes through a series of radially extending openings 136 through an inner wall 138 to an inner chamber 140 from which the lubricant/coolant passes axially toward the die through a series of openings 142. As can be appreciated by those skilled in the art, the configuration of the distributor used in the prior art as designated in FIG. 3 creates a strong swirling motion in chamber 134. However, as the lubricant/coolant passes through-the openings 136 into the inner annular chamber, the lubricant/coolant undergoes a significant loss in kinetic energy by reason of the pressure drop through the openings 136. That effect is again repeated as the lubricant/coolant passes axially outwardly through the series discharge ports 142 for contact with the die.

Figure 4:
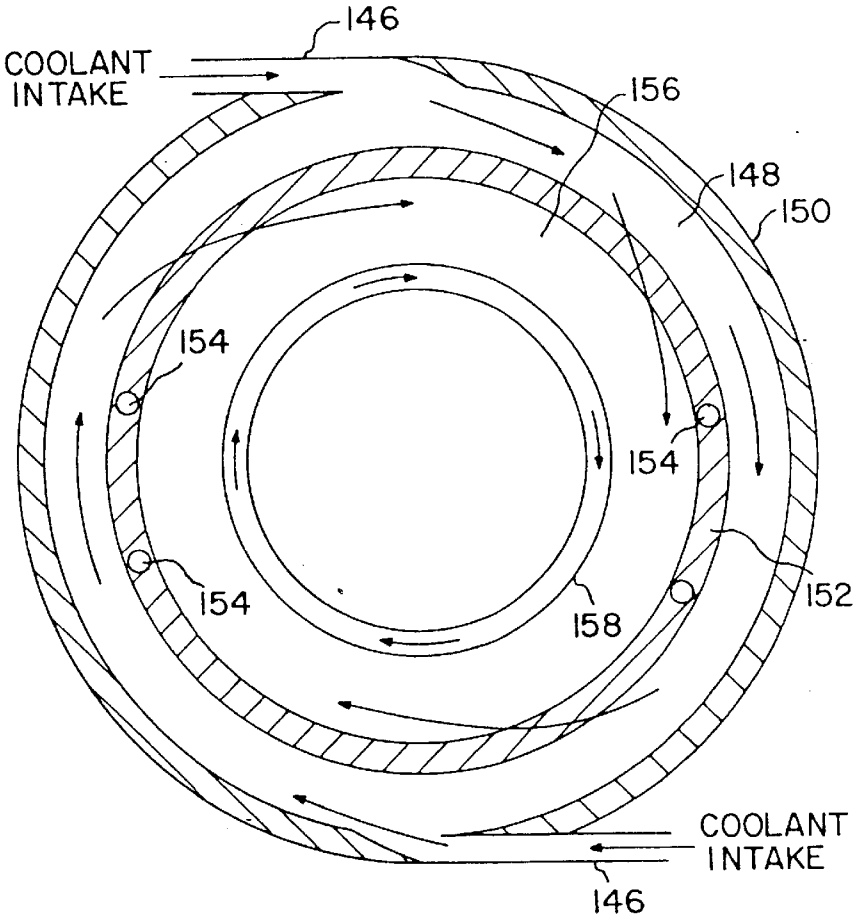
FIG. 4 is a cross sectional view of the coolant distributor preferably employed in the practice of the present invention.

The coolant distributor preferred for use in the present invention is illustrated in FIG. 4 of the drawings and contains a pair of coolant intakes 146 through which the lubricant/coolant is injected into an outer chamber 148 defined between the outer wall 150 and an intermediate wall 152 as illustrated in FIG. 4. Thus, the lubricant/coolant supplied to the intakes 146 is provided with a high kinetic energy, swirling motion in the chamber 148. The inner wall thereof 152 is fully opened to allow the lubricant/coolant to pass from the outer annular chamber 148 to an inner annular chamber 156 with minimum restriction. The opening or slot 154 allows the lubricant/ coolant to pass radially therethrough, there resulting in a minimum energy loss to the lubricant/coolant as it passes from the outer chamber 148 to the inner annular chamber 156 and allowing retention of the swirling motion. The inner chamber 156 thus supplies the lubricant/coolant to an open orifice coolant discharge nozzle 158 to provide a swirling annular sheet of lubricant/coolant passing into the die chamfer 130 illustrated in FIG. 2 to provide coolant to the space between the can wall and the chamfer 130.

In the preferred practice of the present invention, the ironing die employed in the practice of the present invention uses, instead of an obtuse angle, a radius 131 between the chamfer 130 and the working surface 138 of the ironing die 120. By providing a large radius at the intersection of those two surfaces, the ironing die of the present invention provides better coolant diversion to the working zones of the ironing die for better cooling and lubrication.

As indicated, the concepts of the present invention represent a substantial improvement in making hollow workpieces such as beverage containers from aluminum alloys, independent of the manner in which the alloy is prepared. It has been found that the concepts of the present invention can be employed to provide substantial improvement in aluminum alloys produced by conventional ingot casting methods. In the preferred practice of the invention, however, it is preferred to employ the present invention to aluminum alloys which have been rapidly cooled as by strip casting whereby the aluminum alloy is rapidly solidified without substantial precipitation of alloying elements.

The thickness of the strip that can be cast is, as those skilled in the art will appreciate, related to the thickness of the belts 10 and 12, the return temperature of the casting belts and the exit temperature of the strip and belts. In addition, the thickness of the strip depends also on the metal being cast. It has been found that aluminum strip having a thickness of 0.100 inches using steel belts having a thickness of 0.08 inches provides a return temperature of 300 degrees F and an exit temperature of 800 degrees F.

For some applications, it can be desirable to employ one or more belts having longitudinal grooves on the surface of the belt in contact with the metal being cast. Such grooves have been used in single drum casters as described in U.S. Pat. No. 4,934,443.

Figure 5:
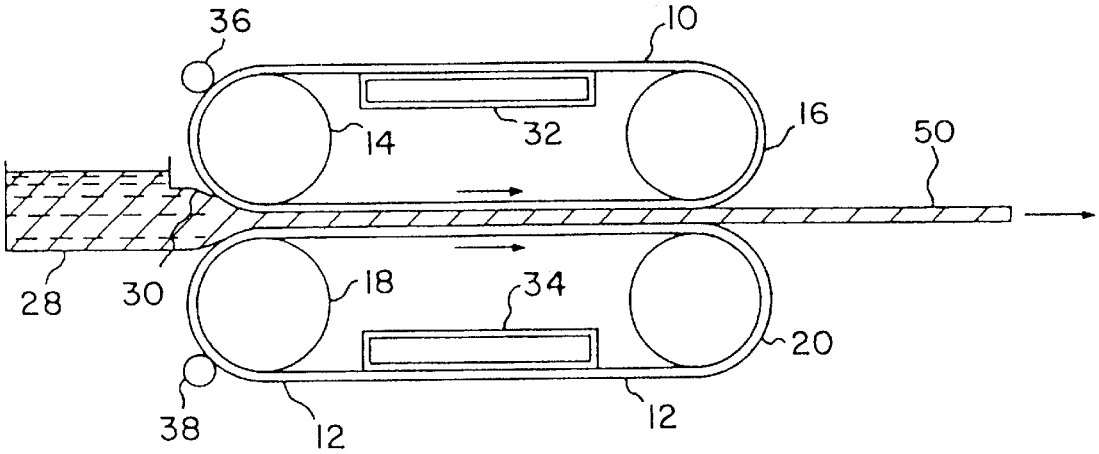
FIG. 5 is a schematic illustration of one form of the casting apparatus which can be used in the practice of the present invention.
Figure 6:
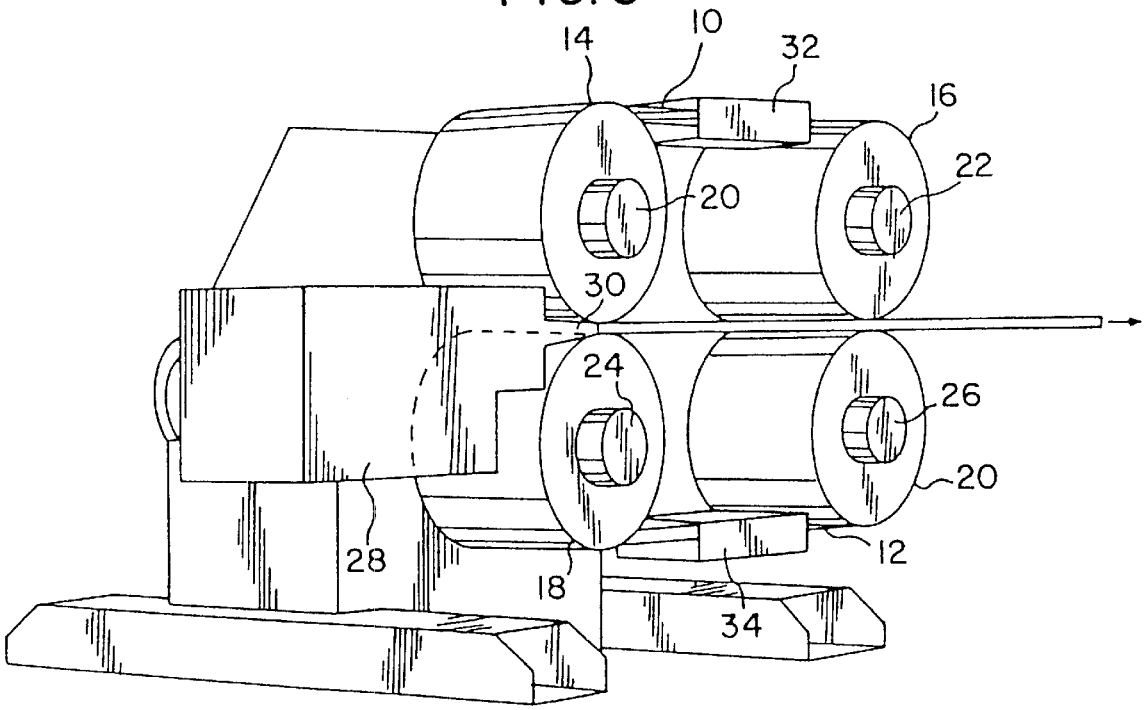
FIG. 6 is a perspective view of the casting apparatus shown in FIG. 1.
Figure 7:
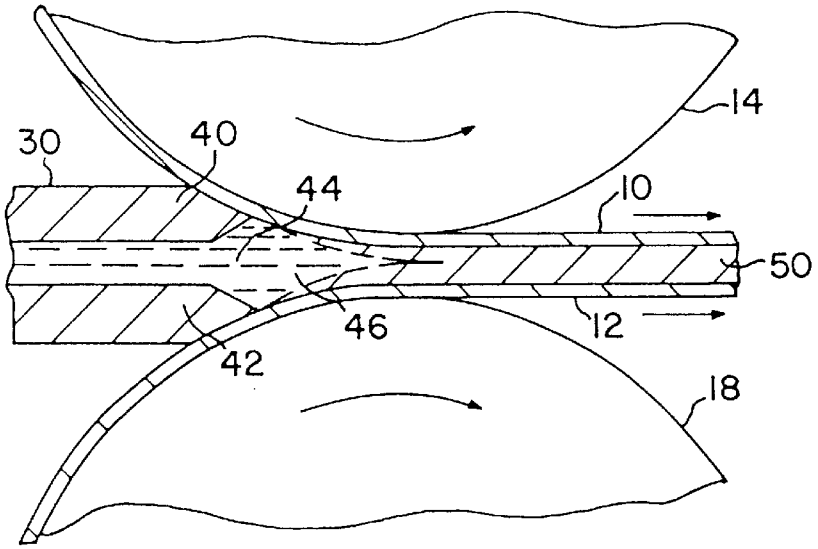
FIG. 7 is a cross-sectional view of the entry of molten metal to the apparatus illustrated in FIGS. 5 and 6.
Figure 8:
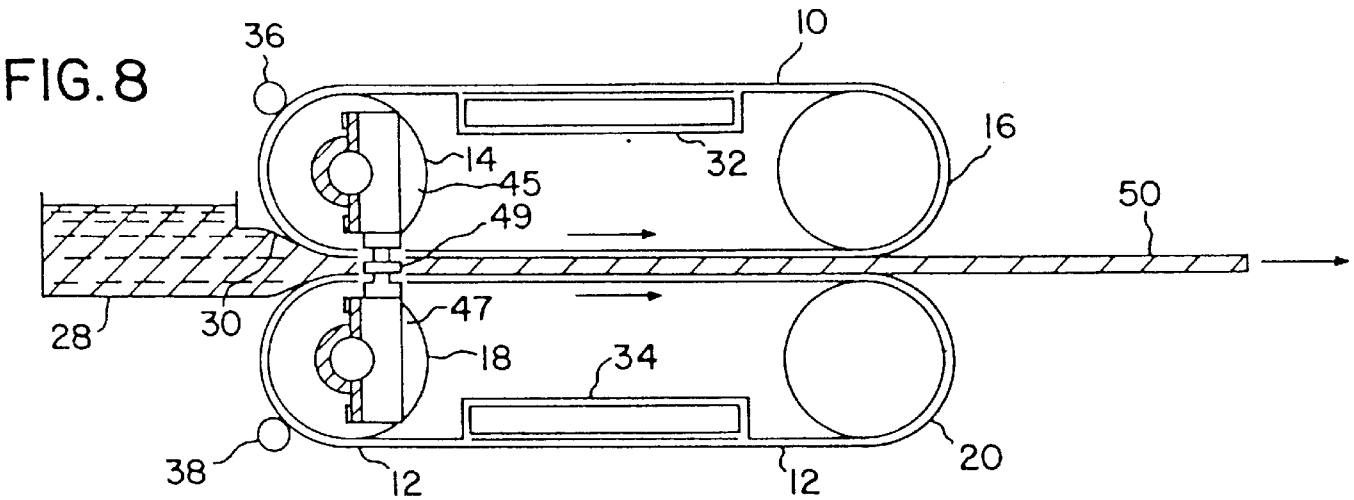
FIG. 8 is a schematic illustration of another casting apparatus which may be used in the practice of the present invention.
Figure 9:
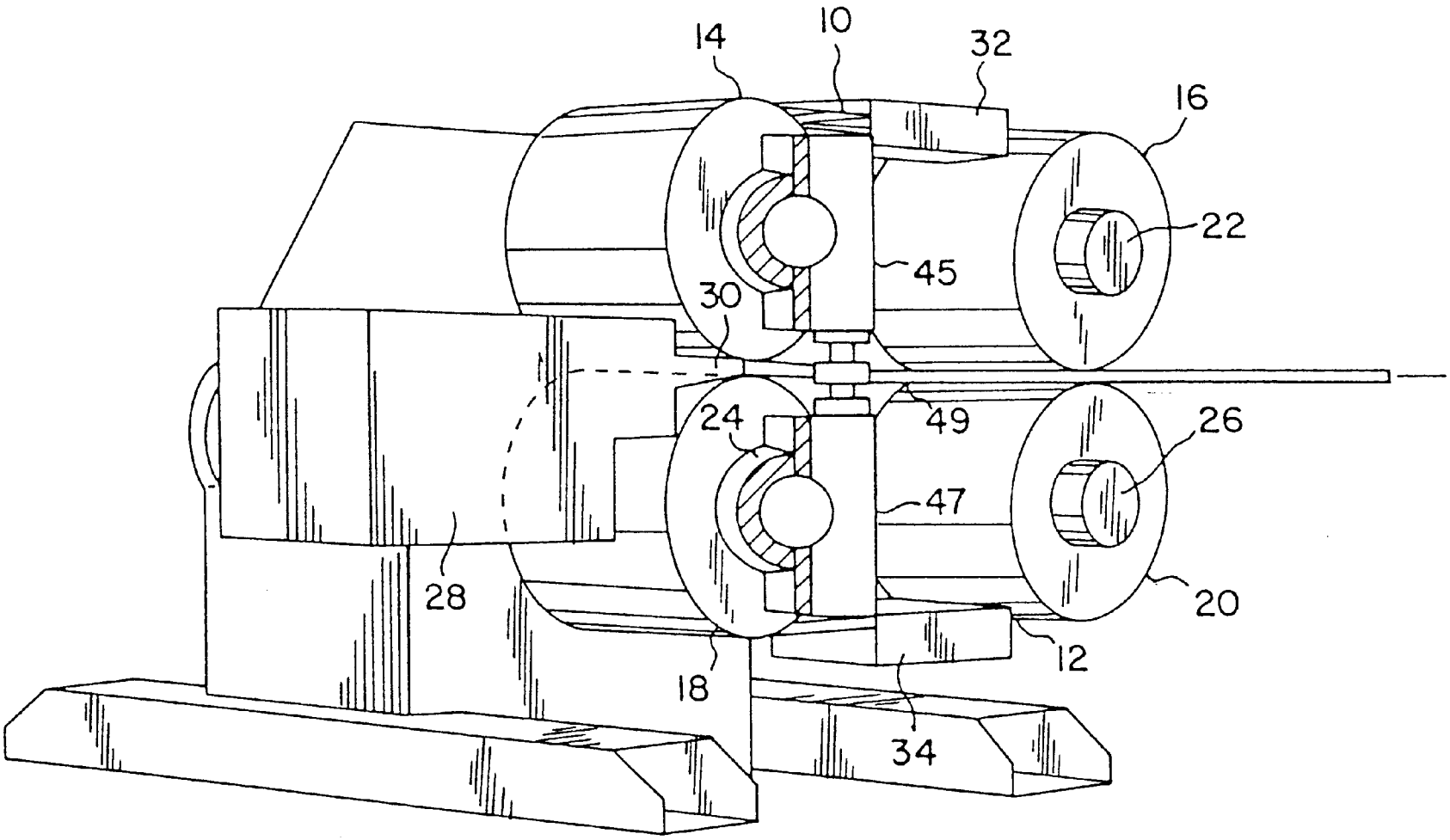
FIG. 9 is a perspective view of the apparatus of FIG. 8.
Figure 10:
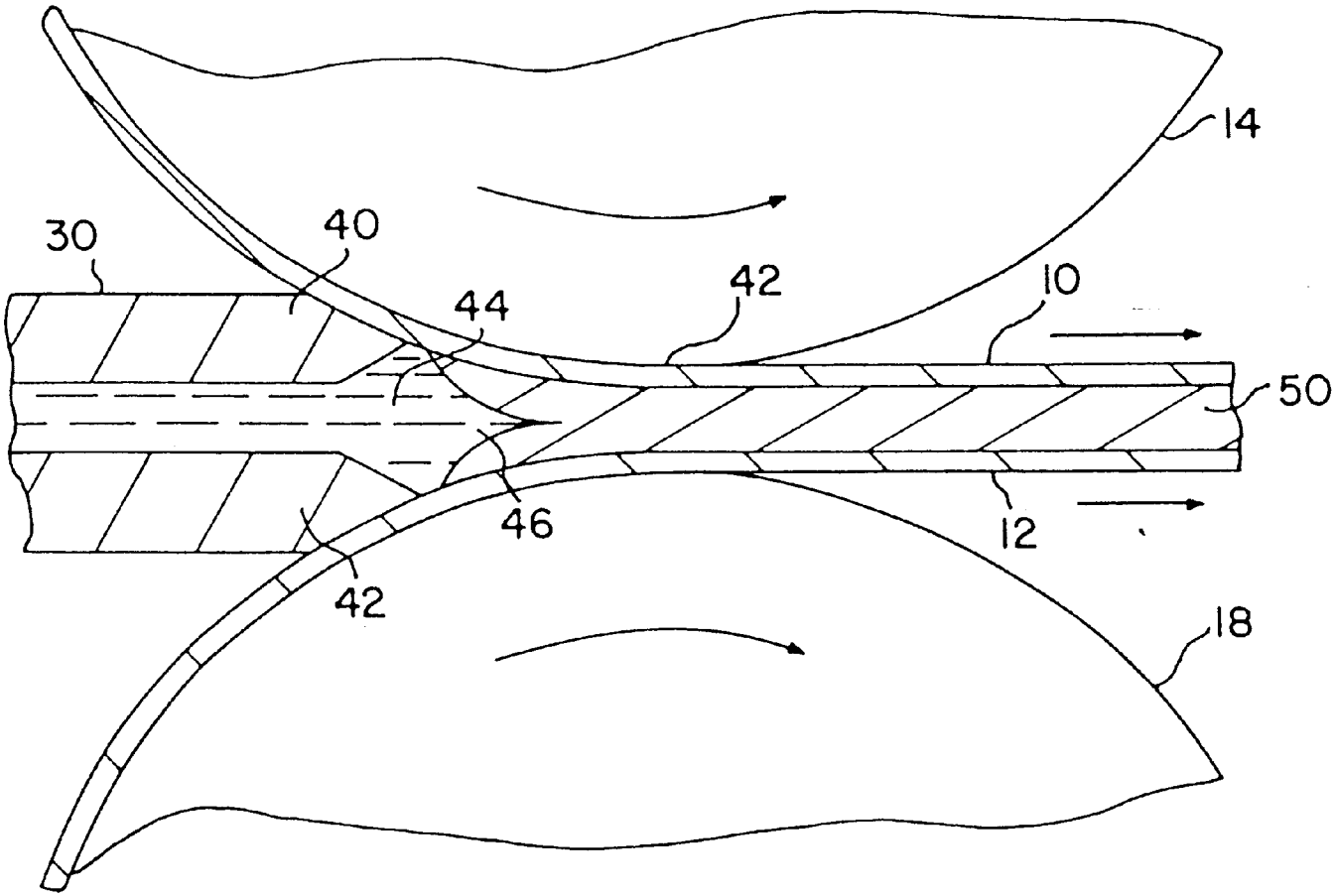
FIG. 10 is a cross-sectional view of the entry of molten metal to the apparatus illustrated in FIGS. 8 and 9.

A highly preferred from of the strip casting apparatus is shown in FIGS. 4 and 6, as described in copending application, Ser. No. 173,369. As there shown, the apparatus includes a pair of endless belts 10 and 12 carried by a pair of upper pulleys 14 and 16 and a pair of corresponding lower pulleys 18 and 20 of FIG. 4. Each pulley is mounted for rotation about an axis 21, 22, 24, and 26 respectively of FIG. 5. One or both of the pulleys 14 and/or 16 is driven by a suitable motor means not illustrated in the drawing for purposes of simplicity. The same is equally true for the lower pulleys 18 and 20. Each of the belts 10 and 12 is an endless belt.

The pulleys are positioned, as illustrated in FIGS. 4 and 5, one above the other with a molding zone therebetween. In the preferred practice of the invention, the gap is dimensioned to correspond to the desired thickness of the metal strip being cast. Thus, the thickness of the metal strip being cast is thus determined by the dimensions of the nip between belts 10 and 12 passing over pulleys 14 and 18 along a line passing through the axis of pulleys 14 and 18 which is perpendicular to the belts 10 and 12.

In accordance with the preferred practice, there is provided means associated with the entry pulleys 14 and 18 to prevent displacement of those pulleys relative to each other. Any suitable apparatus to rigidly fix the relative positions of pulleys 14 and 18 may be used. FIGS. 4 and 5 illustrate a simple mechanism including a pillow block 45 and 47 on each of the axes 21 and 24 of the entry pulleys 14 and 18, respectively, secured to each other by means of a tension member 49. The tension-member may be either fixed or adjustable; it has been found that good results are obtained by simply using a turnbuckle 49 as the tension member to prevent relative displacement of axes 21 and 24 relative to each other. As will be appreciated by those skilled in the art, various other and more sophisticated tension members may likewise be used. For example, use can be made of a hydraulic cylinder as the tension member to prevent relative displacement of the axes 21 and 24 relative to each other. The use of such a hydraulic cylinder has the further advantage that it is adjustable, and thus the tension can be conveniently changed depending on the application and the metal being cast.

Molten metal to be cast is supplied to the molding zone through suitable metal supply means 28 such as a tundish. The inside of tundish 28 corresponds in width to the width of the product to be cast, and can have a width up to the width of the narrower of the belts 10 and 12. The tundish 28 includes a metal supply delivery casting nozzle 30 to deliver a horizontal stream of molten metal to the molding zone between the belts 10 and 12. Such tundishes are conventional in strip casting.

Thus, the nozzle 30, as is best shown in FIG. 6 of the drawings, defines, along with the belts 10 and 12 immediately adjacent to nozzle 30, a molding zone into which the horizontal stream of molten metal flows. Thus, the stream of molten metal flowing substantially horizontally from the nozzle fills the molding zone between the curvature of each belt 10 and 12 to the nip of the pulleys 14 and 18. It begins to solidify and is substantially solidified prior to the point at which the cast strip reaches the nip of pulleys 14 and 18. Supplying the horizontally flowing stream of molten metal to the molding zone where it is in contact with a curved section of the belts 10 and 12 passing about pulleys 14 and 18 serves to limit distortion and thereby maintain better thermal contact between the molten metal and each of the belts as well as improving the quality of the top and bottom surfaces of the cast strip.

In accordance with the preferred embodiment, the casting apparatus of the invention includes a pair of cooling means 32 and 34 positioned opposite that portion of the endless belt in contact with the metal being cast in the molding gap between belts 10 and 12. The cooling means 32 and 34 thus serve to cool the belts 10 and 12 just after they pass over pulleys 16 and 20, respectively, and before they come into contact with the molten metal. In the most preferred embodiment as illustrated in FIGS. 1 and 2, the coolers 32 and 34 are positioned as shown on the return run of belts 10 and 12, respectively. In that embodiment, the cooling means 32 and 34 can be conventional cooling means such as fluid cooling nozzles positioned to spray a cooling fluid directly on the inside and/or outside of belts 10 and 12 to cool the belts through their thicknesses. In that preferred embodiment, it is sometimes desirable to employ scratch brush means 36 and 38 which frictionally engage the endless belts 10 and 12, respectively, as they pass over pulleys 14 and 18 to clean any metal or other forms of debris from the surface of the endless belts 10 and 12 before they receive molten metal from the tundish 28.

Thus, in the practice of this invention, molten metal flows horizontally from the tundish through the casting nozzle 30 into the casting or molding zone defined between the belts 10 and 12 where the belts 10 and 12 are heated by heat transfer from the cast strip to the belts 10 and 12. The cast metal strip remains between and conveyed by the casting belts 10 and 12 until each of them is turned past the centerline of pulleys 16 and 20. Thereafter, in the return loop, the cooling means 32 and 34 cool the belts 10 and 12, respectively, and remove therefrom substantially all of the heat transferred to the belts in the molding zone. After the belts are cleaned by the scratch brush means 36 and 38 while passing over pulleys 14 and 18, they approach each other to once again define a molding zone.

The distal ends of the walls 40 and 42 of the casting nozzle 30 are in substantial proximity of the surface of the casting belts 10 and 12, respectively, and define with the belts 10 and 12 a casting cavity or molding zone 46 into which the molten metal flows through the central opening 44. As the molten metal in the casting cavity 46 flows between the belts 10 and 12, it transfers its heat to the belts 10 and 12, simultaneously cooling the molten metal to form a solid strip 50 maintained between casting belts 10 and 12.

In the preferred practice of the invention, sufficient setback (defined as the distance between first contact 47 of the molten metal 46 and the nip 48 defined as the closet approach of the entry pulleys 14 and 18) should be provided to allow substantially complete solidification prior to the nip 48. In prior art belt casters, the molten metal contacts the belt after the nip 48 in the straight section. Hence, in the present invention solidification is substantially complete prior to the nip 48.

The importance of freezing before the nip 48 in the present invention is that the belts 10 and 12 are much more stable when held in tension on the curved surface of the pulley and distort much less than if the molten metal 46 first contacts the belts 10 and 12 in the straight section as in prior art. Moreover, in the practice of the present invention, there is a momentary high thermal gradient over the belts 10 and 12 when first contacted by molten metal 46. Because each belt is in tension and is well supported prior to the nip by the pulleys 14 and 18, the belts are more stable against distortion arising from that momentary thermal gradient. In addition, the space between the belts at the time that they first come into contact with the molten metal is substantially larger then the gap between the belts corresponding to the thickness of the cast strip. As a result, any distortion in the belts have little effect on the metal being cast at that location. The high thermal gradient largely dissipates before the belts 10 and 12 reach the nip 48, and thus any distortions that do occur diminish as the belts approach the nip.

The importance of freezing or solidification before the nip 48 also arises from the fact that as shown in FIG. 3 of the drawings, the metal solidifying between the curved surfaces in the molding zone prior to the nip has a dimension or thickness greater than the corresponding dimension or thickness of the nip itself. That insures that when the solidified cast metal is advanced to the nip 48, it has a larger dimension than that of the nip, thereby insuring that the nip 48 exerts a compressive force on the cast metal strip and thereby cause elongation to improve not only surface characteristics but also to reduce the tendency of the strip to crack. In addition, the compressive force exerted on the cast metal strip after solidification between the point of solidification and the nip itself insures good thermal contact between the cast metal strip and the belts.

The amount of compressive force is not critical to the practice of the invention. It has been found that the compressive force should be sufficiently high as to insure good thermal contact between the cast metal strip and the belt as well as sufficiently high so as to cause elongation. The elongation is preferably sufficient to insure that the cast metal strip, while it is conveyed from the nip 48 through the remainder of the molding zone, is in a state of longitudinal compression as distinguished from tension. As is described herein above, it has been found that maintaining the cast strip under compressive force serves to minimize cracking that would otherwise occur if the cast strip were maintained under tension. In general, it is desirable that the percent elongation be relatively low, generally below 15 percent, and most preferably below 10 percent. Good results have been achieved by the practice of the invention when the percent elongation is less than 5 percent.

The aluminum alloy strip, once it has been cast, is then subjected to conventional rolling operations, either by hot rolling, cold rolling or combinations thereof to form an aluminum alloy sheet stock. Such rolling operations are themselves conventional inform and no part of the present invention. After the can stock has been formed, either with or without an intermediate annealing step, it is then blanked into a circular configuration and cupped in accordance with well-known techniques.

After cupping, the aluminum alloy cup is then drawn to lengthen the side walls of the cup and ironed in accordance with conventional procedures. For a complete review of such ironing procedures, reference can be made to U.S. Pat. No. 3,942,351 which discloses the use of ironing dies employed with either a mandrel or punch and the ironing die.

It will be understood that various changes and modifications can be made in the details of procedure and use without departing from the operation of the invention, especially as defined in the following claims.

What is claimed is:

1. A process for manufacturing a hollow workpiece comprising the steps of:

(a) providing a punch and a die in a die chamber, said die including a chamfer at one end thereof that is positioned at an angle relative to a longitudinal axis of said die of less than 35 degrees;

(b) contacting a hollow workpiece with said punch and said die; and (c) introducing a fluid into said die chamber in a swirling, annular flow pattern, said fluid being introduced into a space between said die and the workpiece at an angle relative to the longitudinal axis of said punch that is less than the angle of said chamfer.

2. The process of claim 1, wherein said fluid is introduced in the space between the die and the workpiece at an angle between 8 and 20 degrees relative to the longitudinal axis of the punch.

3. The process of claim 2, wherein said chamfer is selected to have a length greater than 0.120 inches.

4. The process of claim 1, wherein the step of introducing a fluid further comprises:

(1) supplying the fluid to at least one fluid intake within a fluid distributor;

(2) passing the fluid to an outer annular chamber in said distributor;

(3) passing the fluid from the outer annular chamber through a series of radially extending openings through a inner wall in said distributor to an inner annular chamber;

(4) passing the fluid from said inner annular chamber to a fluid outlet extending radially inward; and (5) contacting said workpiece with said fluid.

* * * * *